US011334004B2

(12) United States Patent
Bachar et al.

(10) Patent No.: US 11,334,004 B2
(45) Date of Patent: May 17, 2022

(54) TRANSFERRING PRINT AGENT TO CLEANABLE MEDIUM

(71) Applicant: HP Indigo B.V., Amstelveen (NL)

(72) Inventors: Eyal Bachar, Ness Ziona (IL); Ido Gorgani, Ness Ziona (IL); Kostin Cusiner, Ness Ziona (IL); Reut Avigdor, Ness Ziona (IL)

(73) Assignee: HP Indigo B.V., Amstelveen (NL)

( * ) Notice: Subject to any disclaimer, the term of this patent is extended or adjusted under 35 U.S.C. 154(b) by 0 days.

(21) Appl. No.: 17/083,065

(22) Filed: Oct. 28, 2020

(65) Prior Publication Data

US 2021/0041807 A1 Feb. 11, 2021

Related U.S. Application Data

(63) Continuation of application No. 16/344,397, filed as application No. PCT/EP2016/075968 on Oct. 27, 2016, now abandoned.

(51) Int. Cl.
*G03G 15/16* (2006.01)

(52) U.S. Cl.
CPC ..... *G03G 15/161* (2013.01)

(58) Field of Classification Search
CPC ..... G03G 15/161
See application file for complete search history.

(56) References Cited

U.S. PATENT DOCUMENTS 5,870,650 A * 2/1999 Takahashi ..... G03G 15/168 399/98
5,893,018 A 4/1999 De Bock et al.
6,347,212 B1 2/2002 Kosugi
7,066,088 B2 6/2006 McLean et al.
(Continued)

FOREIGN PATENT DOCUMENTS

CN 1198544 11/1998
CN 1869835 A 11/2006
(Continued)

OTHER PUBLICATIONS

HP 5L (C3941A) Service Manual: Toner Cartridge; Step 1: Drum Cleaning; Step 2: Drum Conditioning; Step 3: Image Writing, < http://www.manualslib.com/manual/72343/Hp-5l-C3941a.html?page=67 >.

*Primary Examiner* — Walter L Lindsay, Jr.
*Assistant Examiner* — Milton Gonzalez
(74) *Attorney, Agent, or Firm* — HP Inc. Patent Department

(57) ABSTRACT

In an example, a method includes forming a print agent pattern on an image forming surface and transferring the print agent pattern from the image forming surface to an intermediate transfer member. In a first mode of operation in which a printable substrate is not between the intermediate transfer member and a cleanable medium, the print agent pattern may be transferred from the intermediate transfer member to the cleanable medium and then cleaned from the cleanable medium. In a second mode of operation, the printable substrate may be provided between the intermediate transfer member and the cleanable medium, and the same print agent pattern or a different print agent pattern may be transferred from the intermediate transfer member to the printable substrate.

14 Claims, 3 Drawing Sheets

(56) References Cited

U.S. PATENT DOCUMENTS

| | | | | |
|---|---|---|---|---|
| 7,677,716 | B2 | 3/2010 | Vega et al. | |
| 7,840,148 | B2 | 11/2010 | Tanaka | |
| 7,872,660 | B2 | 1/2011 | Zeng et al. | |
| 8,095,032 | B2 * | 1/2012 | Torimaru | G03G 15/161 399/101 |
| 8,121,513 | B2 * | 2/2012 | Izawa | G03G 15/161 399/101 |
| 8,891,994 | B2 * | 11/2014 | Tabata | G03G 21/0005 399/71 |
| 9,102,138 | B2 | 8/2015 | Suzuki et al. | |
| 2006/0269328 | A1 | 11/2006 | Ochiai | |
| 2010/0310279 | A1 | 12/2010 | Mizumoto | |
| 2012/0148283 | A1 | 6/2012 | Sano et al. | |

FOREIGN PATENT DOCUMENTS

| | | | |
|---|---|---|---|
| CN | 101351748 | | 1/2009 |
| CN | 103707670 | B | 7/2015 |
| JP | 11194546 | | 7/1999 |
| JP | 2004151237 | A | 5/2004 |
| JP | 2005234162 | | 9/2005 |
| JP | 2012032483 | | 2/2012 |

* cited by examiner

TRANSFERRING PRINT AGENT TO CLEANABLE MEDIUM

RELATED APPLICATIONS

The present application is a continuation of U.S. patent application Ser. No. 16/344,397, which was filed on Apr. 24, 2019, and was a regional phase application of PCT/EP2016/075968, filed on Oct. 27, 2016. Both these applications are incorporated herein by reference.

BACKGROUND

Some print apparatus apply print agents such as inks or toners directly to a substrate such as paper, card, plastic metal and the like in a pattern to form an image (which may comprise any combination of text, pictures, patterns and the like) on the substrate. Other print apparatus form patterns of print agents on an image forming member and apply the formed patterns of ink to a substrate. In some examples of so called 'offset' printing, an image is first formed in electronic ink on an electrostatic plate bearing a charge pattern corresponding to the image to be formed, the pattern is transferred to an intermediate transfer member in a first transfer, for example under an applied voltage, and then transferred to a substrate in a second transfer.

BRIEF DESCRIPTION OF DRAWINGS

Non-limiting examples will now be described with reference to the accompanying drawings, in which.

DETAILED DESCRIPTION

Test print runs may be carried out on a print apparatus, for example to test a new component, for quality assurance, to test longevity of at least one component, to test consistency of image quality, or the like. Such test runs may include printing hundreds or even thousands of images, consuming significant quantities of substrate and print agent resources.

Figure 1:
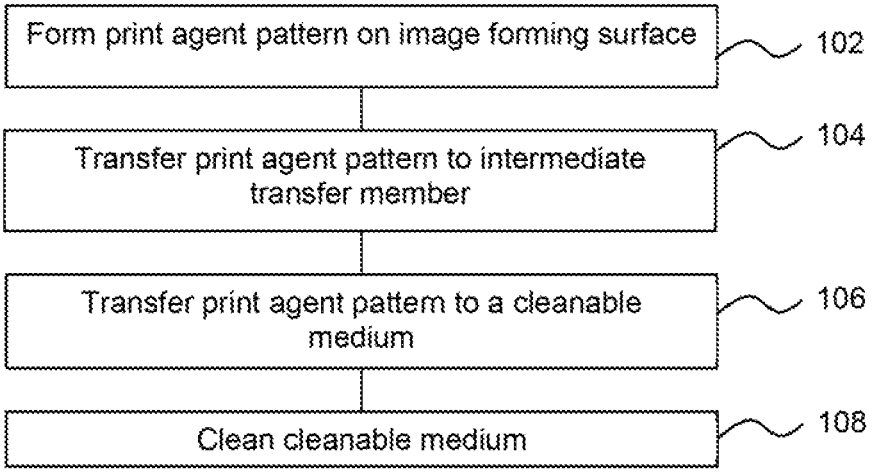
FIG. 1 is a flowchart of an example method of cleaning print agent from a cleanable medium.

FIG. 1 shows a method, which may be a method of testing a print apparatus. Block 102 comprises forming a print agent pattern on an image forming surface. For example, in a Liquid Electro Photographic (LEP) print apparatus, a pattern to be printed may first be formed as a electrostatic pattern of charges on the image forming surface (which may be curved around a cylinder). Electronic ink, which comprises electrically charged toner particles suspended in a liquid, is attracted to the image forming surface according to the charge pattern to form the print agent pattern. In other examples, the pattern of print agent may be formed in some other way.

Block 104 comprises transferring the print agent pattern from the image forming surface to an intermediate transfer member. In some examples, the intermediate transfer member may comprise a 'blanket', for example formed of rubber. In some examples, the image is transferred under a voltage.

In some examples, the pattern may be at least partially dried or cured while on the intermediate transfer member. In some examples, the pattern may be heated while on the intermediate transfer member. In some examples, a number of 'separations', i.e. patterns formed of different (e.g. different color) print agents, may be built up on the intermediate transfer member before being further transferred. In other examples, separations may be transferred from the intermediate transfer member individually.

When printing to a substrate, the pattern on the intermediate transfer member may at this point be transferred to a substrate. This transfer may be effected by urging the substrate against the intermediate transfer member. However, in this example, block 106 comprises transferring the print agent pattern to a cleanable medium. The cleanable medium may comprise for example a plastic (for example, PVC, PET or BOPP) sheet, or a paper or fabric sheet with a coating such as a primer or the like. In some examples, the cleanable medium provides a substrate which accepts a transfer from the intermediate transfer agent and allows a pattern of print agent to be peeled or cleaned off (or peeled or cleaned off with relative ease compared to other mediums). In some examples, the cleanable medium may be formed as an endless loop of the cleanable medium material. For example, the cleanable medium may be provided on, or driven by, a roller or the like.

Block 108 comprises cleaning the print agent from the cleanable medium. For example, print agents such as inks or toners may be scraped and/or sponged from the cleanable medium. Cleaning the print agent may comprise use of a cleaning agent such as a solvent. The solvent may be selected so as to remove a relatively 'sticky' print agent layer as the layer may not be fully dry when applied to the cleanable medium. The solvent may be selected so as to have minimal or no adverse effects on print apparatus components such as any of, or any combination of, the intermediate transfer member, the image forming surface, any print agent source, apparatus for charging the imaging forming surface, heating apparatus, cleaning apparatus, or the like. In one example, the solvent may be an ester based on lactic acid.

As the cleanable medium is cleaned, this allows it to be reused. For example, blocks 102 to 108 may be carried out repeatedly (noting that, as mentioned above, in some examples, blocks 102 and 104 may be carried out multiple times before the method moves on to block 106, as separations may be built up on the intermediate transfer member). This in turn reduces substrate wastage and substrate handling. As the print process is carried through to the 'second transfer' stage, all previous printing stages, such as the delivery of print agent to the image forming surface, formation of a charge pattern on the image forming surface, transfer of the pattern to the intermediate transfer member, and the like, can be verified.

Figure 2:
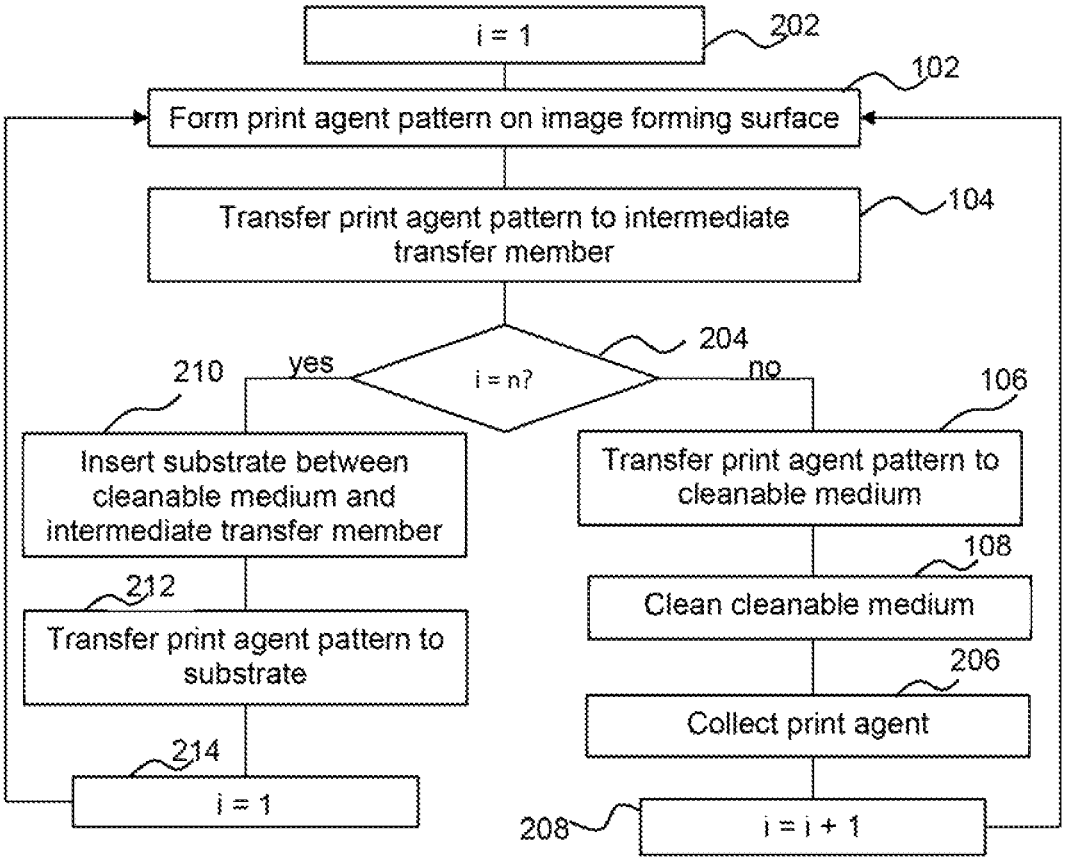
FIG. 2 is a flowchart of another example method of cleaning print agent from a cleanable medium.

FIG. 2 is another example of a method, which may be a method of testing a print apparatus. In FIG. 2, it is assumed that separations are to be transferred individually, although this need not be the case in all examples.

In this example, block 202 comprises setting a counter i, initially to 1. Blocks 102 to 104 are carried out as described in relation to FIG. 1. Block 204 comprises checking to see if the counter i is equal to a number n. The number could be any number. For the sake of example, n may be 500, 1000, 2000, or the like.

If i is not equal to n, the process continues with block 106 and block 108, which operate as described above. In this example, the method then proceeds to block 206 comprises collecting the print agent cleaned from the cleanable medium (which in some examples may be mixed with a cleaning agent). This collected print agent may for example be at least partially recycled. For example, a solvent or carrier fluid may be extracted from collected print agent and used to manufacture fresh print agent. In block 208, the counter i is incremented by 1, and the method returns to block 102 (until the print run is terminated).

If however it is determined in block 204 that i is equal to n, block 210 comprises inserting a printable substrate (for example, a paper page) between the cleanable medium and the intermediate transfer member and block 212 comprises transferring the print agent pattern to the printable substrate. The counter i is then reset to 1 in block 214, and the method returns to block 102 (until the print run is terminated).

The method of FIG. 2 therefore allows printing of a substrate every n impressions. Such a substrate may be visually or automatically checked to determine if the image formed thereon corresponds to an intended image (for example in terms of colors, image position, sharpness and the like). This means that the image quality may be periodically checked in a long print run, while not unnecessarily wasting substrate supplies. In some examples, the value of n may change over a test run. In some examples, the value of n may be user configurable. In some examples, if the image is determined to be of insufficient quality, the test run may be interrupted. In some examples, a plurality of images may be printed to the substrate in succession before the method returns to printing images to the cleanable medium.

In FIG. 2, the substrate is provided while the cleanable medium is in place. In other examples, the cleanable medium may be removed before a substrate is inserted.

Figure 3:
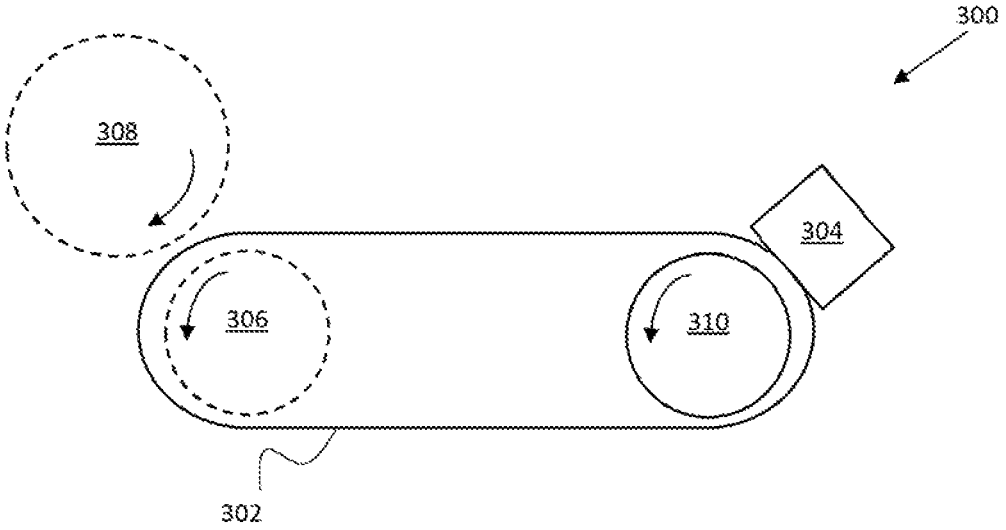
FIG. 3 is a simplified schematic diagram of example print test apparatus.

FIG. 3 is an example of a print test apparatus 300, which may in some examples be removably coupled to a print apparatus for use. The print test apparatus 300 comprises a reusable cleanable surface 302, and a cleaning apparatus 304.

The reusable cleanable surface 302, in use of the print test apparatus 300, is to be provided around at least a portion of a surface of an impression cylinder 306. The impression cylinder 306 is shown in dotted outline as it is a component of the print apparatus and not the test apparatus 300. An impression cylinder 306 may generally be provided to urge a substrate onto an intermediate transfer member 308 (also shown in dotted outline to aid understanding, however it may be noted that the intermediate transfer member 308 is a component of the print apparatus and not the test apparatus 300), although in use of the print test apparatus 300, it is a reusable cleanable surface 302 which is passed between the impression cylinder 306 and the intermediate transfer member 308.

The reusable cleanable surface 302 comprises, in this example, an 'endless belt', i.e. a continuous loop which may be arranged, in use of the print test apparatus 300, to run around the surface of the impression cylinder 306 and in this example is driven by a roller 310 (although other drive mechanism could be used, such as stepper motors or the like). In other examples, the impression cylinder 306 and/or the intermediate transfer member 308 may be driven to drive the cleanable surface 302, in which case the roller 310 may be a support and/or tensioning roller.

The reusable cleanable surface 302 may comprise for example a plastic surface (for example, a PVC, PET or BOPP sheet), a primer-coated paper surface or a primer-coated fabric surface or the like. The reusable cleanable surface 302 may for example cover substantially the length of the impression cylinder 306 (or may be as wide a belt as can be reliably passed over the impression cylinder 306). The reusable cleanable surface 302 may have any attribute discussed in relation to the cleanable medium above (and vice versa).

In this example, the reusable cleanable surface 302 is an endless surface, which provides a simple manner of reusing the reusable cleanable surface 302. However, the cleanable surface 302 could comprise one or a plurality of individual sheets. In this example, the cleanable surface 302 runs around a roller 310. However, in other examples, as is shown in FIG. 4 below, the reusable cleanable surface 302 could in effect be the surface of the impression cylinder 306.

In this example, the print test apparatus 300 is a removable apparatus, which may be permanently or removably housed in a print apparatus. In some examples, the reusable cleanable surface 302 may be removed from the impression cylinder 306 for 'normal' printing, and placed thereover for test runs. This allows the reusable cleanable surface 302 to be selected for appropriate qualities, for example the ease with which print agent may be removed therefrom, without considering, for example, the substrate handling performance of the reusable cleanable surface 302.

Figure 4:
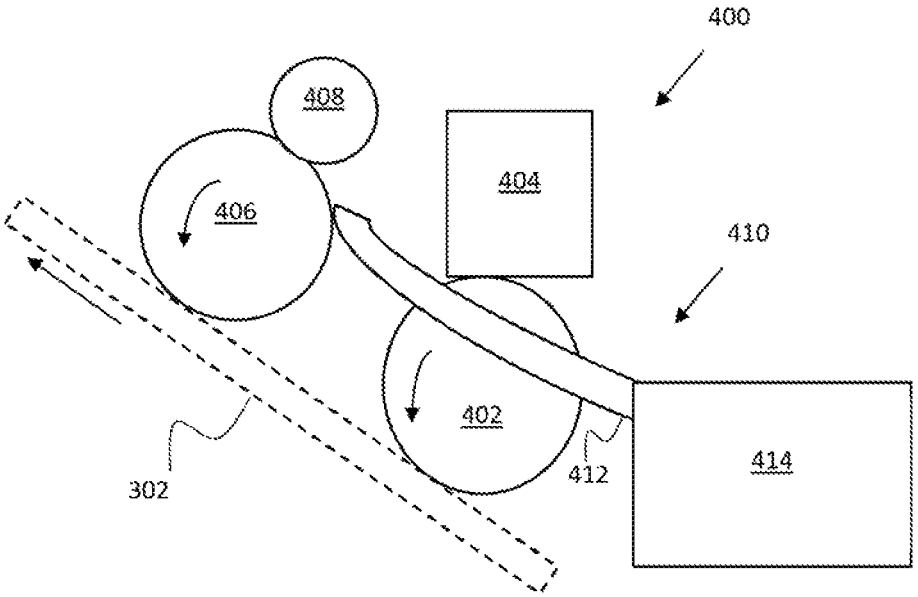
FIG. 4 is a simplified schematic diagram of example cleaning apparatus.

An example cleaning apparatus 304 is now described in relation to FIG. 4, which shows a cleaning apparatus 400 comprising, in this example, a wetting roller 402, which is connected a cleaning fluid reservoir 404. The cleaning fluid may be any suitable cleaning fluid depending on the surfaces, print agent type, vulnerability of components of the print apparatus or print test apparatus 300 or the like. In this example, the cleaning apparatus 400 further comprises a sponge roller 406, a squeeze roller 408, and a print agent collection system 410. The wetting roller 402 delivers cleaning fluid from the reservoir 404 to the reusable cleanable surface 302, and the cleaning fluid along with print agent is removed from the cleanable surface 302 by the sponge roller 406. The sponge of the sponge roller 406 is compressed by the squeeze roller 408, squeezing any print agent/cleaner fluid carried therein out into the print agent collection system 410, which in this example comprises a channel 412 which is connected to a collection reservoir 414. In some examples, the collection reservoir 414 may comprise an outlet such that it empties into another container.

The print agent collection system 410 collects print agent cleaned from the cleanable surface. This may be stored for subsequent disposal or recycling.

In this example, the cleaning apparatus 400 may be provided on the upwards portion of the cleanable surface's travel. However, in other examples, the reusable cleanable surface 302 may be directed upwards via rollers or the like, or some other design of cleaning apparatus 304 may be used.

In other examples, the cleaning apparatus 304 may comprise additional or alternative components. For example, the cleaning apparatus 304 may comprise an 'air knife', brush, other roller(s), or the like. In some examples, an electrical bias which may assist in removing electrically charged particles from the reusable cleanable surface 302, may be used within the cleaning apparatus 304.

Figure 5:
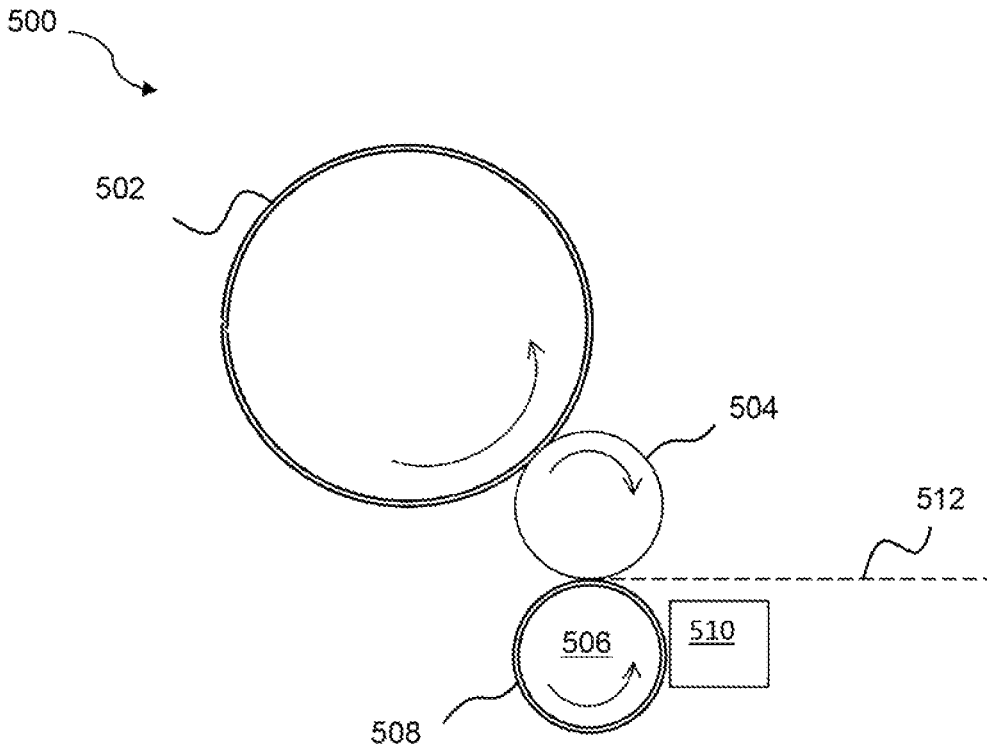
FIG. 5 is a simplified schematic diagram of example print apparatus.

FIG. 5 is an example of a print apparatus 500 comprising an electrostatic imaging plate 502, an intermediate transfer member 504, an impression cylinder 506, an endless cleanable medium 508 and a cleaning station 510.

In this example, the electrostatic imaging plate 502 is wrapped to form a cylinder, and the intermediate transfer member 504 is also a cylinder, for example covered in a rubber blanket although other examples of electrostatic imaging plates and intermediate transfer members may be used. The endless cleanable medium 508 may in general be arranged about at least a portion of the impression cylinder 506, and in this example comprises the curved surface thereof. The print apparatus 500 has have two modes of operation, as set out below.

In a first mode of operation, the intermediate transfer member 504 is to transfer an image from the electrostatic imaging plate 502 to a printable substrate 512 provided between the impression cylinder 506 and the intermediate transfer member 504. Such a printable substrate 512 may be provided by a transport mechanism, and may pass between the impression cylinder 506 and the intermediate transfer member 504, which in this example comprise counter rotating cylinders.

In a second mode of operation, the intermediate transfer member 504 is to transfer an image from the electrostatic imaging plate 502 to the endless cleanable medium 508. In this example, the endless cleanable medium 508 comprises a surface of the impression cylinder 506, and may be permanently arranged about the impression cylinder 506 in both modes of operation. However, in other examples, the endless cleanable medium 508 may be removeable. In some examples, the endless cleanable medium 508 may comprise a belt as shown in FIG. 3. The endless cleanable medium 508 may comprise any of the features described in relation to the cleanable medium or reusable cleanable surface 302 above.

The cleaning station 510 cleans the endless cleanable medium 508. In some examples, the cleaning station 510 may be a cleaning apparatus 400 as described above, or comprise any of the features discussed in relation thereto.

For example, the print apparatus 500 may be a Liquid Electro Photographic (LEP) printing apparatus which may be used to print a print agent such as an electronic ink composition. A photo charging unit may deposit a uniform static charge on the electrostatic imaging plate 502, which in some examples may be a Photo Imaging Plate, or 'PIP' of the electrostatic imaging cylinder and then a laser imaging portion of the photo charging unit dissipates the static charges in selected portions of the image area on the PIP to leave a latent electrostatic image. The latent electrostatic image is an electrostatic charge pattern representing the image to be printed. The electronic ink composition is then transferred to the PIP from a print agent source, which may comprise a Binary Ink Developer (BID) unit, and which may present a uniform film of the print agent to the PIP. The print agent may be electrically charged by virtue of an appropriate potential applied to the print agent. The charged ink composition, by virtue of an appropriate potential on the electrostatic image areas, is attracted to the latent electrostatic image on the PIP. The electrostatic imaging plate 502 then has a developed print agent electrostatic ink composition image on its surface.

The image is then transferred from the electrostatic imaging plate 502 to the intermediate transfer member 504, in some examples by virtue of an appropriate potential and/or pressure applied between the electrostatic imaging plate 502 and the intermediate transfer member 504, such that the charged print agent is attracted to intermediate transfer member 504. The image may then be dried and fused on the intermediate transfer member 504 before being transferred to the substrate/endless cleanable medium 508 depending on the operational mode (for example, adhering to the colder surface thereof, and/or under pressure).

Other methods of forming print agent patterns and transferring these between surfaces may be used in other examples.

Although not shown, the print apparatus 500 may comprise additional apparatus, such as print agent source(s) (e.g. Binary Ink Developer (BID) unit(s)), charging unit(s) to charge the electrostatic imaging plate 502, selective charge dissipation apparatus (for example a laser imaging apparatus to dissipate charge in selective regions of a PIP), electric field units, for example to transfer a pattern of print agent from the electrostatic imaging plate 502 to the intermediate transfer member 504, other cleaning apparatus, for example associated with the electrostatic imaging plate 502 and/or intermediate transfer member 504, heating and/or curing apparatus, substrate transport apparatus, and the like. The print apparatus 500 may also comprise control circuitry, for example to control the print apparatus 500 to operate in one of the first and second modes of operation, and/or to transfer between the modes of operation. Such control circuitry may also control other aspects of the print apparatus, such as print operations.

The present disclosure is described with reference to flow charts. Although the flow charts described above show a specific order of execution, the order of execution may differ from that which is depicted. Blocks described in relation to one flow chart may be combined with those of another flow chart. It shall be understood that some blocks in the flow charts, as well as combinations of the blocks, can be realized by machine readable instructions, such as any combination of software, hardware, firmware or the like. Such machine readable instructions may be included on a computer readable storage medium (including but is not limited to disc storage, CD-ROM, optical storage, etc.) having computer readable program codes therein or thereon.

The machine readable instructions may, for example, be executed by a general purpose computer, a special purpose computer, an embedded processor or processors of other programmable data processing devices to realize the functions described in the description and diagrams. In particular, a processor or processing apparatus may execute the machine readable instructions. Thus functional modules of the apparatus and devices may be implemented by a processor executing machine readable instructions stored in a memory, or a processor operating in accordance with instructions embedded in logic circuitry. The term 'processor' is to be interpreted broadly to include a CPU, processing unit, ASIC, logic unit, or programmable gate array etc. The methods and functional modules may all be performed by a single processor or divided amongst several processors.

Such machine readable instructions may also be stored in a computer readable storage that can guide the computer or other programmable data processing devices to operate in a specific mode. Further, some teachings herein may be implemented in the form of a computer software product, the computer software product being stored in a storage medium and comprising a plurality of instructions for making a computer device implement the methods recited in the examples of the present disclosure.

While the method, apparatus and related aspects have been described with reference to certain examples, various modifications, changes, omissions, and substitutions can be made without departing from the spirit of the present disclosure. It is intended, therefore, that the method, apparatus and related aspects be limited only by the scope of the following claims and their equivalents. It should be noted that the above-mentioned examples illustrate rather than limit what is described herein, and that those skilled in the art will be able to design many alternative implementations without departing from the scope of the appended claims.

Features described in relation to one example may be combined with features of another example.

The word "comprising" does not exclude the presence of elements other than those listed in a claim, "a" or "an" does not exclude a plurality, and a single processor or other unit may fulfil the functions of several units recited in the claims.

The features of any dependent claim may be combined with the features of any of the independent claims or other dependent claims.

The invention claimed is:

1. A method comprising:

forming a print agent pattern on an image forming surface;

transferring the print agent pattern from the image forming surface to an intermediate transfer member;

in a first mode of operation in which a printable substrate is not between the intermediate transfer member and a cleanable medium:

transferring the print agent pattern from the intermediate transfer member to the cleanable medium, and cleaning the print agent pattern from the cleanable medium;

in a second mode of operation:

providing the printable substrate between the intermediate transfer member and the cleanable medium, and transferring the same print agent pattern or a different print agent pattern from the intermediate transfer member to the printable substrate;

incrementing a counter each time the print agent pattern is cleaned from the cleanable medium; and transitioning between the first and second modes of operation in response to the counter satisfying a threshold.

2. The method of claim 1 in which print agent is transferred to and cleaned from the cleanable medium repeatedly.

3. The method of claim 1 comprising collecting print agent cleaned from the cleanable medium.

4. The method of claim 1, wherein the cleanable medium is an endless surface.

5. The method of claim 4, comprising driving the endless surface with a roller.

6. The method of claim 1, wherein the cleanable medium comprises a plastic surface, a primer-coated paper surface, or a primer-coated fabric surface.

7. The method of claim 1, wherein cleaning the print agent pattern from the cleanable medium comprises scraping the print agent from the cleanable medium.

8. The method of claim 1, wherein cleaning the print agent pattern from the cleanable medium comprises sponging the print agent from the cleanable medium using a solvent.

9. A print apparatus comprising:

an electrostatic imaging plate;

an intermediate transfer member;

an impression cylinder;

an endless cleanable medium; and a cleaning station to clean the endless cleanable medium;

wherein, in a first mode of operation, the intermediate transfer member is to transfer an image from the electrostatic imaging plate to a printable substrate via the intermediate transfer member wherein the printable substrate is provided between the impression cylinder and the intermediate transfer member;

wherein, in a second mode of operation, the intermediate transfer member is to transfer an image from the electrostatic imaging plate to the endless cleanable medium via the intermediate transfer member;

wherein a counter is incremented each time the cleaning station cleans the image from the endless cleanable medium; and wherein the print apparatus is transitioned between the first and second modes of operation in response to the counter satisfying a threshold.

10. The print apparatus of claim 9 in which the endless cleanable medium is arranged about at least a portion of the impression cylinder.

11. The print apparatus of claim 9 in which the endless cleanable medium comprises a surface of an impression cylinder.

12. The print apparatus of claim 9 in which the endless cleanable medium comprises an endless belt provided between the impression cylinder and the intermediate transfer member.

13. The print apparatus of claim 9 in which the electrostatic imaging plate is photo imaging plate and is mounted on an imaging cylinder.

14. The print apparatus of claim 9 in which the cleaning station comprises a reservoir to contain cleaning fluid and a print agent collection system.

* * * * *